US008261639B2

(12) United States Patent
Liao

(10) Patent No.: US 8,261,639 B2
(45) Date of Patent: Sep. 11, 2012

(54) SCREWDRIVER

(75) Inventor: Jung-Chen Liao, Taiping (TW)

(73) Assignee: Crossman Corporartion, Taichung County (TW)

( * ) Notice: Subject to any disclaimer, the term of this patent is extended or adjusted under 35 U.S.C. 154(b) by 381 days.

(21) Appl. No.: 12/766,891

(22) Filed: Apr. 25, 2010

(65) Prior Publication Data

US 2011/0259161 A1 Oct. 27, 2011

(51) Int. Cl.
*B25B 23/16* (2006.01)

(52) U.S. Cl. ..... 81/177.1; 81/900; 81/436

(58) Field of Classification Search ..... 81/177.1, 81/436, 489, 900; 30/340
See application file for complete search history.

(56) References Cited

U.S. PATENT DOCUMENTS 2,899,996 A * 8/1959 Stockman ..... 81/177.1
4,951,533 A * 8/1990 Hillinger ..... 81/177.1
5,740,586 A * 4/1998 Gomas ..... 16/436
5,964,009 A * 10/1999 Hoepfl et al. ..... 16/430
6,108,870 A * 8/2000 Lo ..... 16/431
6,230,366 B1 * 5/2001 Lin ..... 16/431
6,345,556 B1 * 2/2002 Lin ..... 81/177.1
6,749,790 B1 * 6/2004 Lieser et al. ..... 264/279
6,763,747 B1 * 7/2004 Gierer et al. ..... 81/489
7,311,023 B2 * 12/2007 Ponzini ..... 81/177.1
7,882,769 B2 * 2/2011 Lin ..... 81/177.1
2006/0016299 A1 * 1/2006 Chen ..... 81/436
2006/0048613 A1 * 3/2006 Abel et al. ..... 81/177.2
2007/0113710 A1 * 5/2007 Chen ..... 81/60
2010/0107826 A1 * 5/2010 Gauthier et al. ..... 81/177.1
2010/0154601 A1 * 6/2010 Christopher ..... 81/60
2010/0192733 A1 * 8/2010 Hsieh ..... 81/177.1
2012/0000324 A1 * 1/2012 Pelletier et al. ..... 81/63

* cited by examiner

*Primary Examiner* — Debra S Meislin

(57) ABSTRACT

A screwdriver comprises a shaft, and a handle core, a handle body and an outer layer formed on the shaft by injection molding. The multilayer structure of the screwdriver prevents the impact force from being transmitted to the user's hand and causing discomfort, and can relieve the discomfort caused by the impact force applied to the screwdriver while reducing the impact force loss during impact operation.

9 Claims, 7 Drawing Sheets

SCREWDRIVER

BACKGROUND OF THE INVENTION

1. Field of the Invention

The present invention relates to a handle tool, and more particularly to a screwdriver.

2. Description of the Prior Art

Referring to FIG. 1, a conventional screwdriver comprises a shaft 11 and a handle 12. The shaft 11 includes a connecting end and a driving head 111 which is cross shaped or flat or in other shapes. The handle 12 is connected to the connecting end of the shaft 11, and has a diameter greater than that of the shaft 11. On the outer surface of the handle 12 is provided an anti-slip portion 121. The handle 12 is gripped by a user to drive a screw (not shown) with the driving head 111 of the shaft 11. However, this screwdriver has the following disadvantages that need to be improved.

Besides being used to drive screws, the screwdriver can also be used as an impact tool to punch holes or to pry fasteners. Since the handle 12 is a single-layer structure, when an impact force is applied to the end surface 122 of the handle 12, a shock is produced and will be transferred to the user's hand griping the handle, causing discomfort. Moreover, the shock caused by the impact force will be transmitted along the handle 12 to the user's hand, so that the applied impact force cannot be fully transmitted to the driving head 111 of the shaft 11, resulting in loss of impact force.

The present invention has arisen to mitigate and/or obviate the afore-described disadvantages.

SUMMARY OF THE INVENTION

The primary object of the present invention is to provide a screwdriver which is capable of relieving the discomfort caused by the impact force applied to the screwdriver while reducing the impact force loss.

To achieve the above object, a screwdriver in accordance with the present invention comprises a shaft, and a handle core, a handle body and an outer layer formed on the shaft by injection molding. The shaft includes a driving head and an engaging portion at both ends thereof, and the engaging portion includes a first section and a second section. The handle core includes a fixing portion fixed at the first section of the shaft, an impact portion and a plurality of protrusions annularly located on an outer surface of the handle core, each two neighboring protrusions defines a recess therebetween. The handle body covers the second section of the shaft and the handle core and includes an open end for exposing the impact portion of the handle core, a groove defined in an outer surface of the handle body, and a plurality of engaging recesses and engaging protrusions formed in an inner surface of the handle body for engaging with the protrusions and recesses of the handle core. The outer layer is disposed in the groove of the handle body.

The handle core is preferably made by injection molding nylon.

The protrusions and recesses of the handle core are preferably located between the fixing portion and the impact portion.

The handle body is preferably made by injection molding acrylonitrile-butadene-styrene compound.

The handle body is preferably made of compound consisting of Polypropylene, fiber and thermo plastic rubber.

The outer layer is preferably made of injection molding of thermo plastic rubber.

The outer layer is preferably made of injection molding of oil resistant thermo plastic rubber.

A stop portion is preferably formed between the engaging portion and the driving head of the shaft and stopped against an end surface of the handle body 40.

The first section of the shaft is preferably provided with a first wing portion which is symmetrically located on an outer periphery of the first section, and the second section of the shaft is also provided with a second wing portion symmetrically located on an outer periphery of the second section, the fixing portion of the handle core is provide with a first covering portion for covering the first wing portion, and the handle body is provided with a second covering portion for covering the second wing portion.

DETAILED DESCRIPTION OF THE PREFERRED EMBODIMENTS

Figure 1:
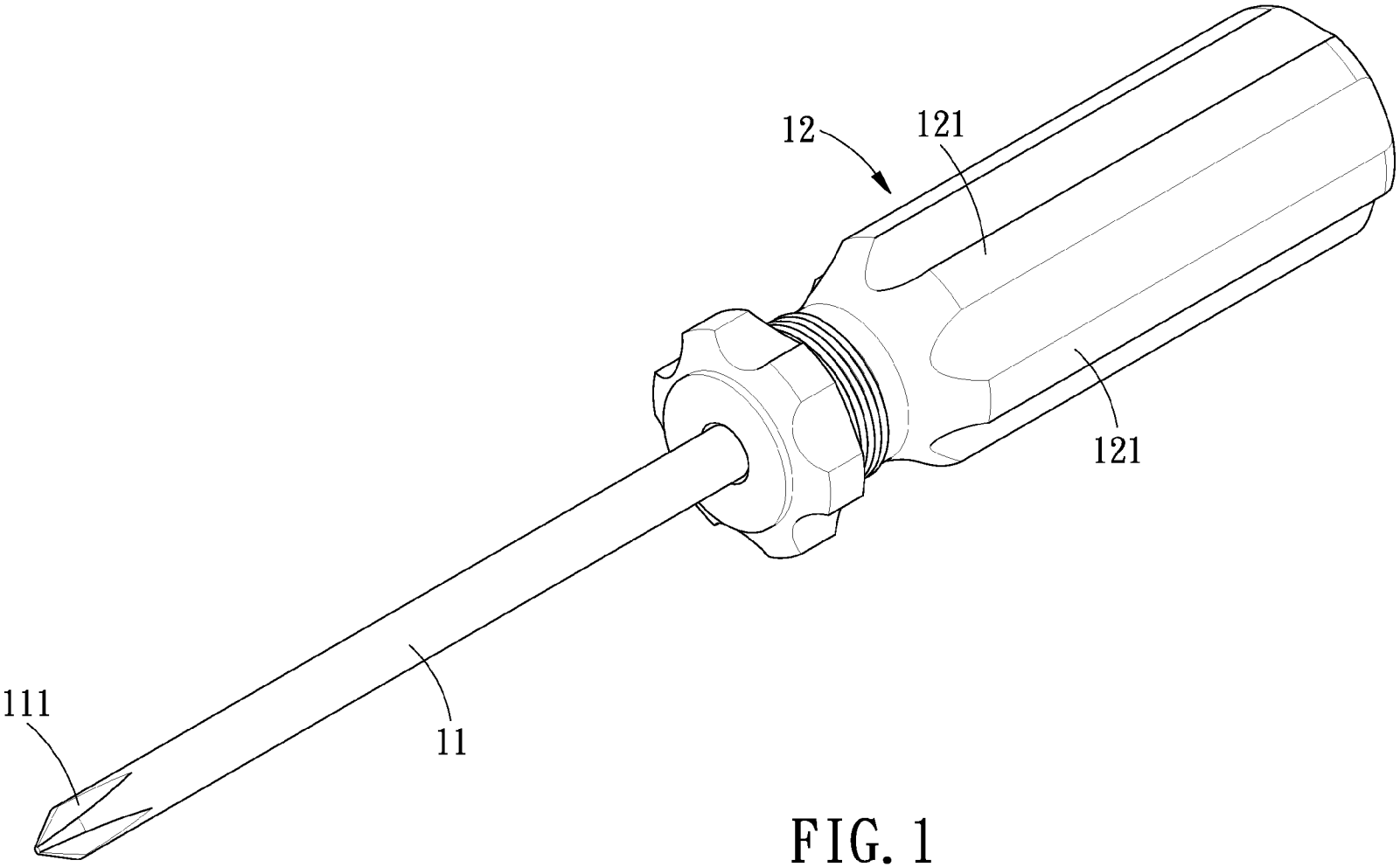
FIG. 1 PRIOR ART
FIG. 1 is a perspective view of a conventional screwdriver.
Figure 2:
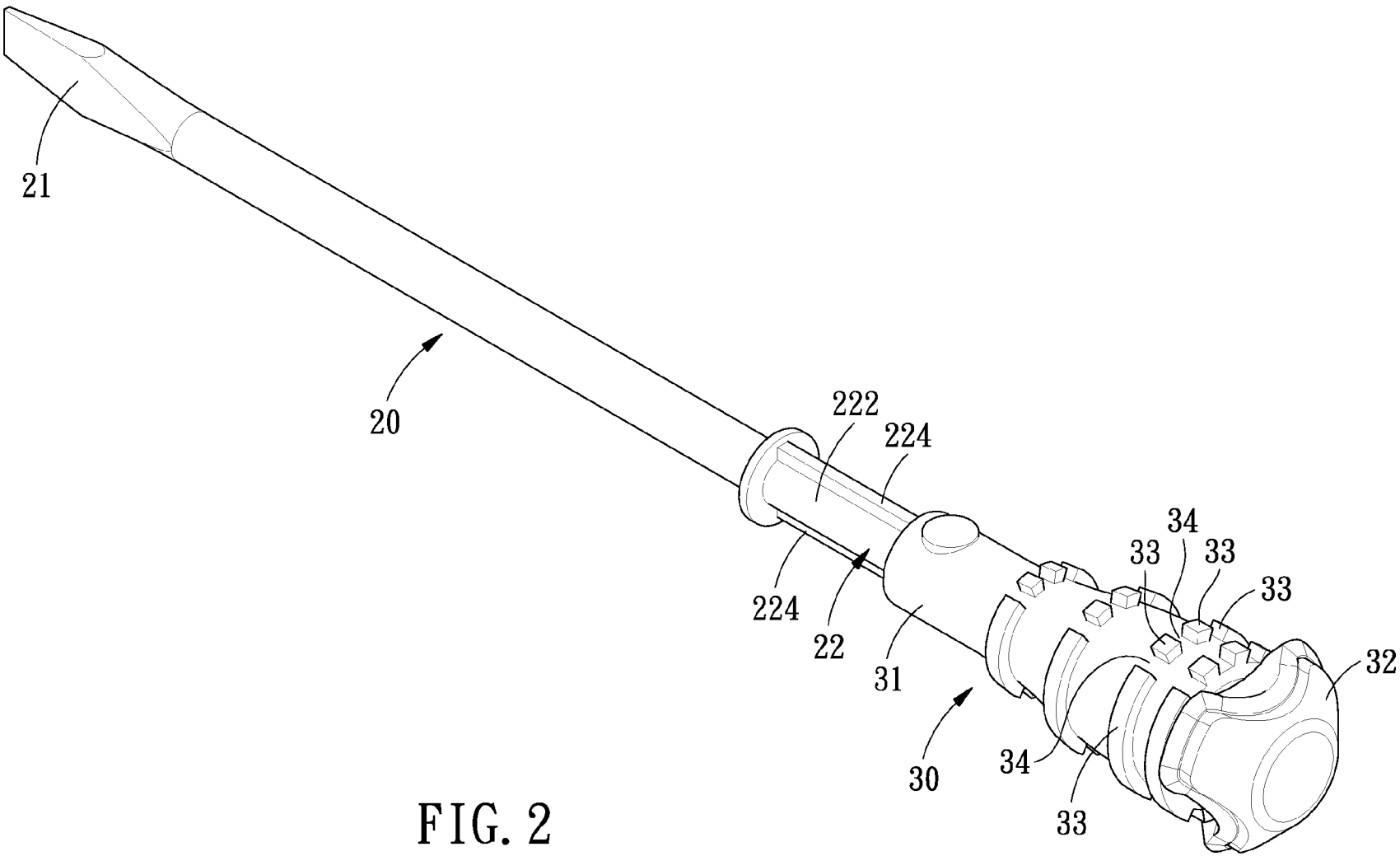
FIG. 2 is a perspective view of a screwdriver in accordance with the present invention, showing that a handle core is injection molded onto the shaft.
Figure 3:
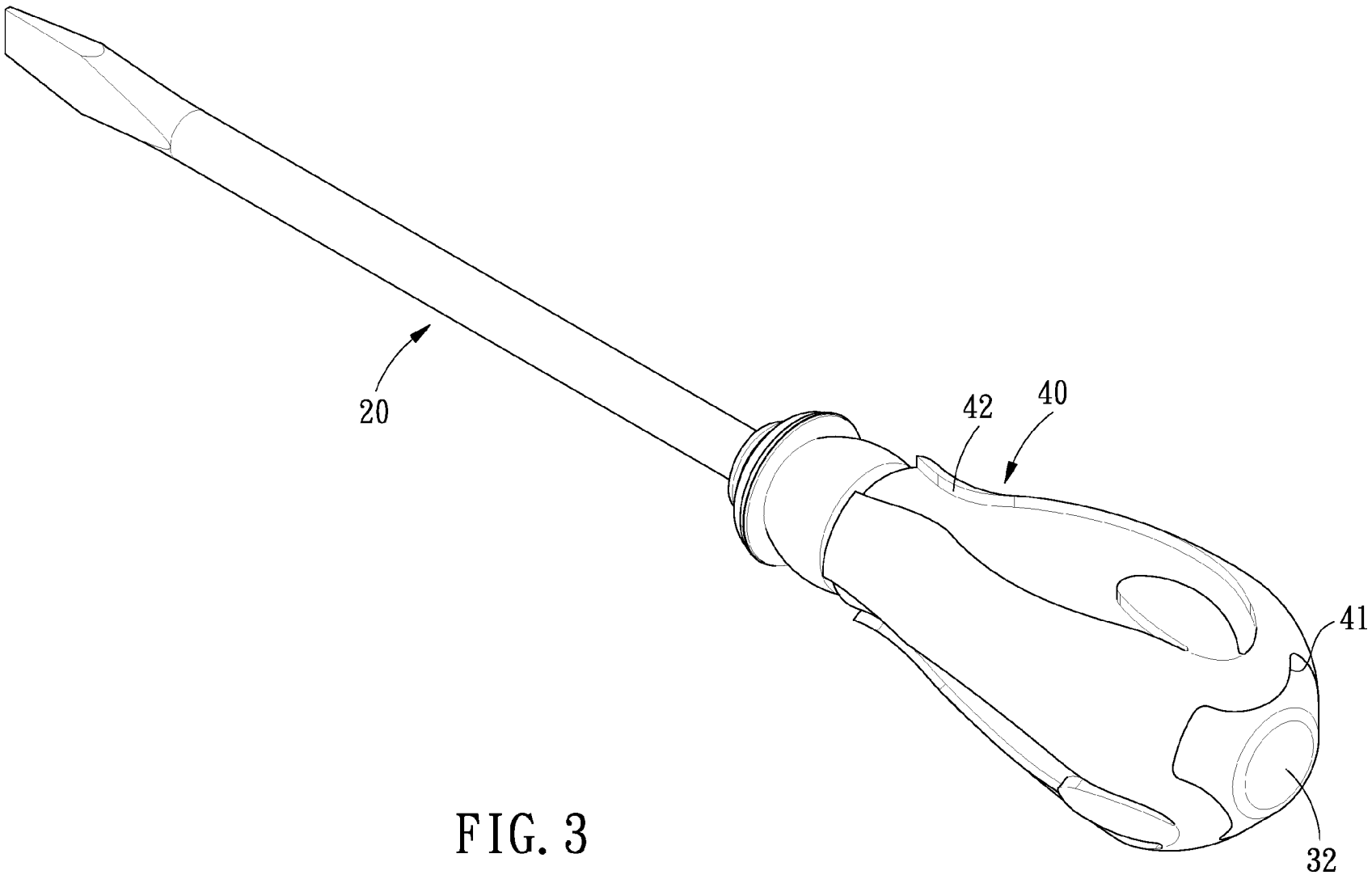
FIG. 3 is a perspective view of the screwdriver in accordance with the present invention, showing that a handle body is injection molded onto the shaft.

The present invention will be clearer from the following description when viewed together with the accompanying drawings, which show, for purpose of illustrations only, the preferred embodiment in accordance with the present invention.

Referring to FIGS. 2-7, a screwdriver in accordance with the present invention comprises: a shaft 20, and a handle core 30, a handle body 40 and an outer layer 50 formed on the shaft 20 by injection molding.

The shaft 20 is metal and includes a driving head 21 at one end thereof for driving different types of fasteners. The driving head 21 is a flat head in this embodiment, and it can also be cross, hexagonal or other shapes. The other end of the shaft 20 is an engaging portion 22 which consists of a first section 221 and a second section 222. The first section 221 is provided with a first wing portion 223 which is symmetrically located on the outer periphery of the first section 221, and the second section 222 is also provided with a second wing portion 224 symmetrically located on the outer periphery of the second section 222.

The handle core 30 is made by injection molding nylon and comprises a fixing portion 31 fixed at the first section 221 of the shaft 20, an impact portion 32 and a plurality of protrusions 33 annularly located on an outer surface of the handle core 30 between the fixing portion 31 and the impact portion 32. The fixing portion 31 comprises a first covering portion 311 for covering the first wing portion 223. Each two neighboring protrusions 33 define a recess 34 therebetween, and the protrusions 33 and the recesses 34 are arranged in four annular rows.

The handle body 40 is made by injection molding ABS (acrylonitrile-butadene-styrene) compound and covers the second section 222 of the shaft 20 and the handle core 30. The handle body 40 is provided with an open end 41 for exposing the impact portion 32 of the handle core 30, a groove 42 defined in the outer surface thereof, a plurality of engaging recesses 43 and engaging protrusions 44 formed in an inner surface of the handle body 40 for engaging with the protrusions 33 and recesses 34 of the handle core 30, and a second covering portion 45 for covering the second wing portion 224 of the shaft 20.

The outer layer 50 is made by injection molding of TPR (thermo plastic rubber) and disposed in the groove 42 of the handle body 40.

Figure 5:
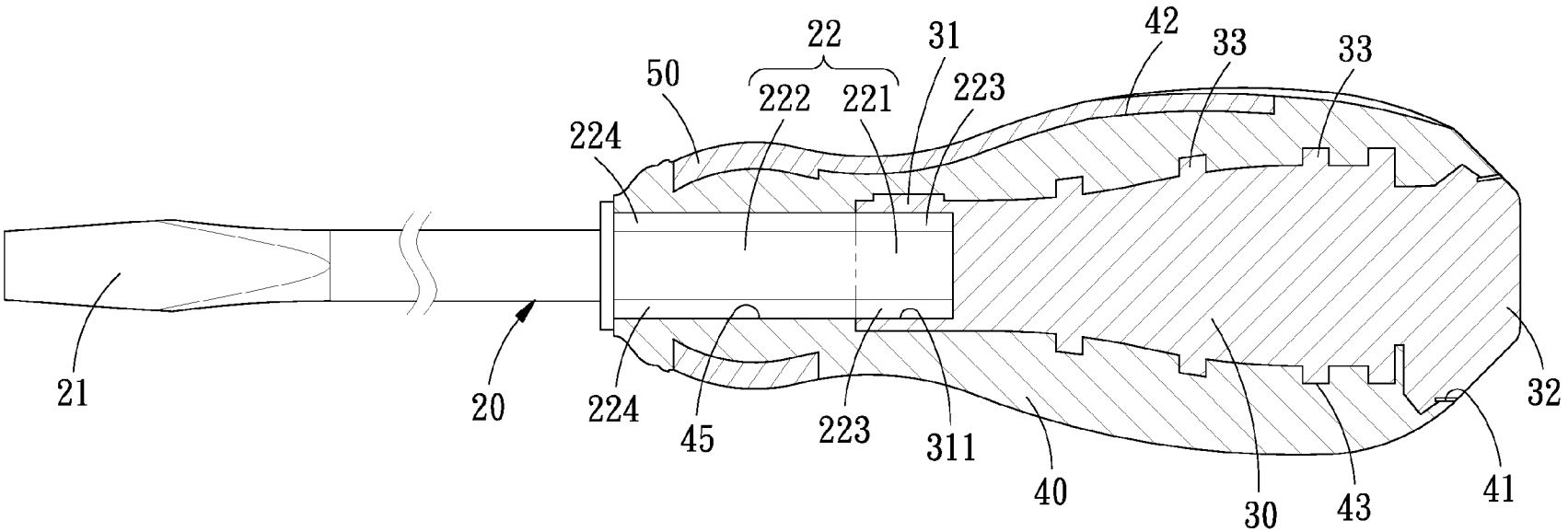
FIG. 5 is an axial cross sectional view of the screwdriver in accordance with the present invention.
Figure 7:
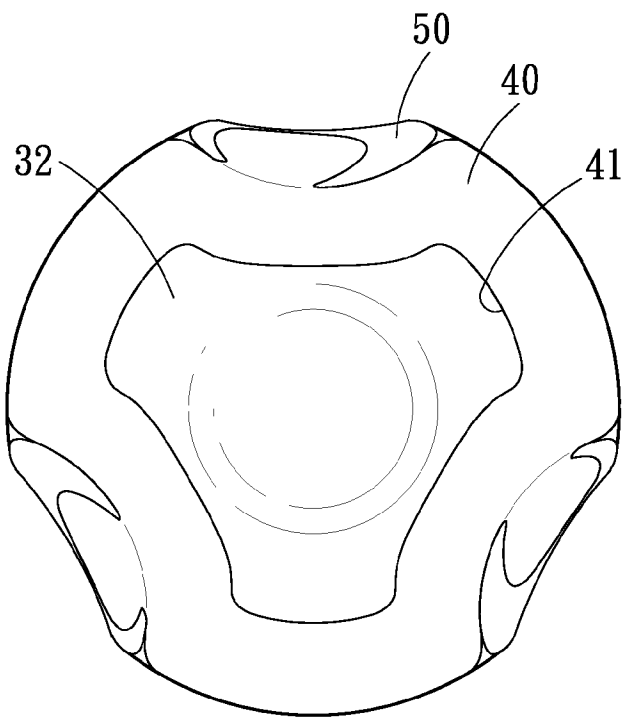
FIG. 7 is a rear view of the screwdriver in accordance with the present invention.
Figure 6:
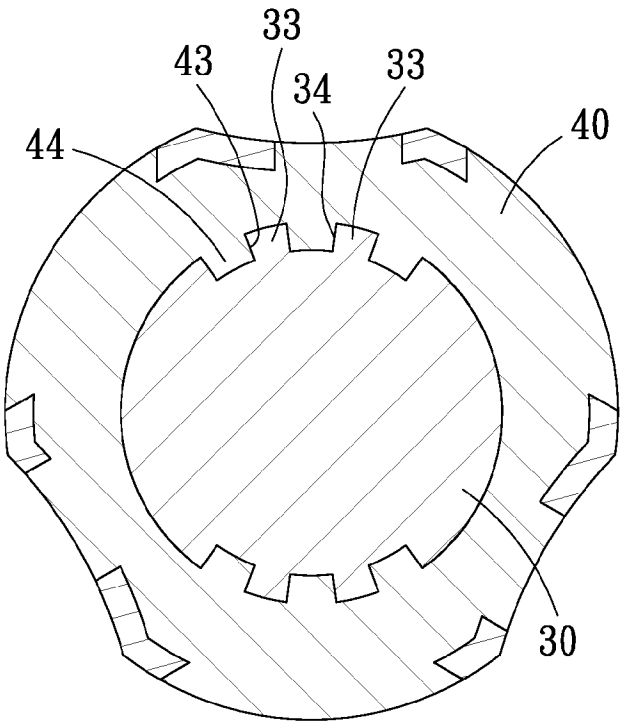
FIG. 6 is a radial cross sectional view of the screwdriver in accordance with the present invention.

The abovementioned is the relations of the respective components of the present invention, for a better understanding of its functions, reference should be made to FIG. 5.

When the present invention is used as a pry an impact tool to punch holes or pry fasteners, impact force is applied to the impact portion 32 of the handle core 30, at this moment, the handle core 30 will transfer the impact force in the longitudinal direction directly to the driving head 21 of the shaft 20 to carry out impacting, while the impact force transmission in the transverse direction will be absorbed by the protrusions 33 annularly arranged on the outer surface of the handle core 30, thus preventing the impact force from being transmitted to the user's hand and causing discomfort. Besides, the applied impact force is fully transmitted to the driving head 21 of the shaft 20, reducing the impact force loss. The handle core 30 is surrounded and covered by the handle body 40 and the outer layer 50, respectively; such multilayer structure can relieve the discomfort caused by the impact force and reduce the impact force loss.

It is noted that since the handle core 30 is made by injection molding nylon, it has the properties of high impact proof, weather resistant, conductivity and insulation. The handle body 40 has improved properties of covering and stable since it is made by injection molding ABS, and it can also be made of compound consisting of PP (Polypropylene), fiber and TPR. The outer layer 50 is made by injection molding of TPR, which provides the screwdriver with the properties of oil resistant, anti-slip and shock-absorbing. The outer layer 50 can also be made of oil resistant TPR.

Referring to FIGS. 5 and 6 again, since the handle core 30 is provided on its outer surface with the annularly arranged protrusions 33 and the recesses 34, and the handle body 40 is provided with the engaging recesses 43 and engaging protrusions 44 for engaging with the protrusions 33 and recesses 34 of the handle core 30, which can effectively transmit the torque of the screwdriver and prevent the relative displacement and deformation of the handle core 30 and the handle body 40.

Referring to FIGS. 3 and 4 again, the handle body 40 is structured such that the rear half of the handle body 40 is larger and located farther from the driving head 21 of the shaft 20 than the front half of the handle body 40. Beside, the groove 42 of the handle body 40 includes a rotation part corresponding to user's palm and a gripping part corresponding to user's fingers, making the user's palm and fingers feel more comfortable during screw driving operation while reducing fatigue after the outer layer 50 is injection molded in the groove 42.

Figure 4:
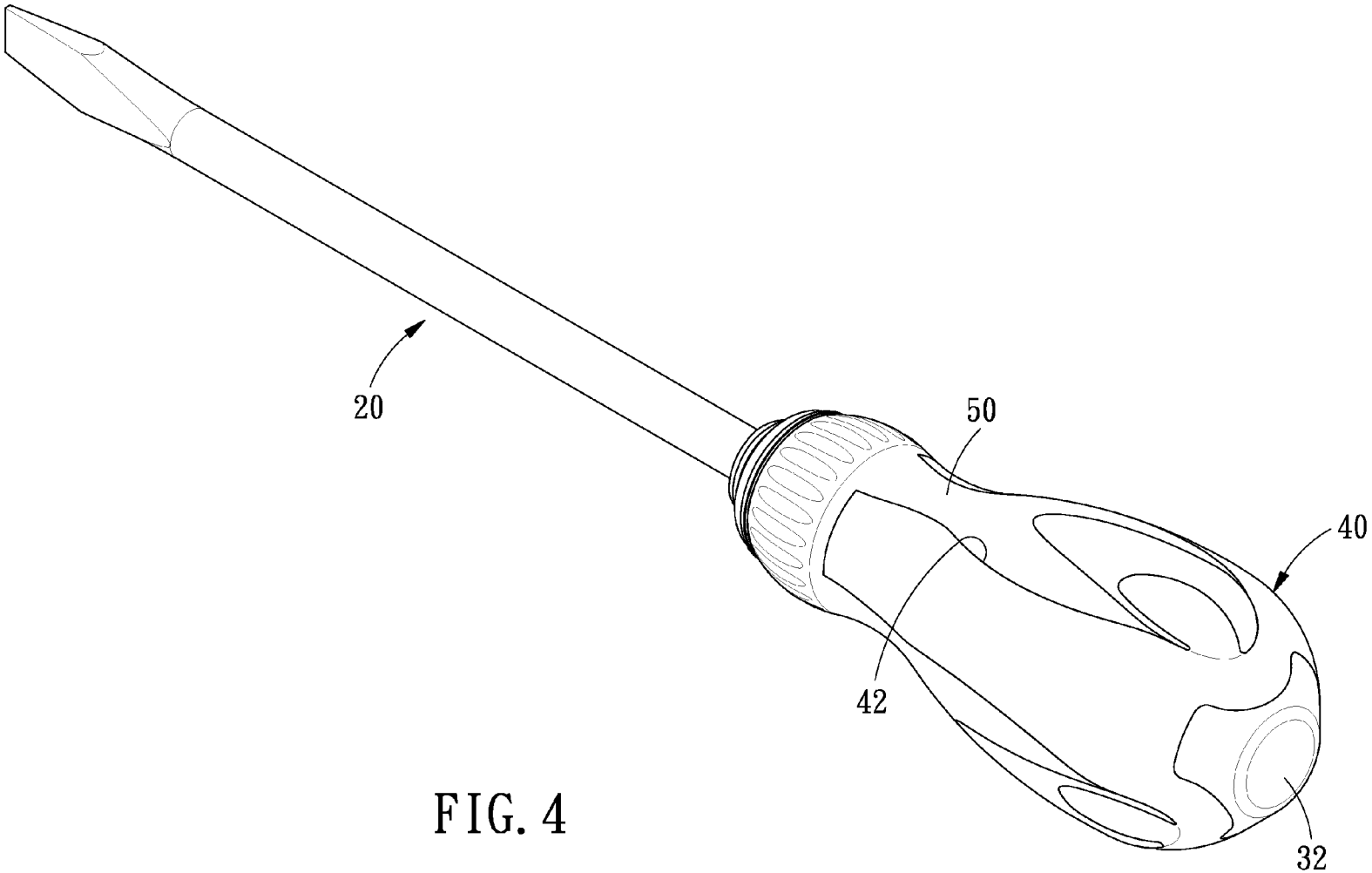
FIG. 4 is a perspective view of the screwdriver in accordance with the present invention, showing that an outer layer is injection molded onto the shaft.

As shown in FIG. 4, the handle body 40 in accordance with the present invention is shaped into a triangular three dimensional structure, which is ergonomically deigned for facilitating gripping and rotation of the screwdriver.

Figure 8:
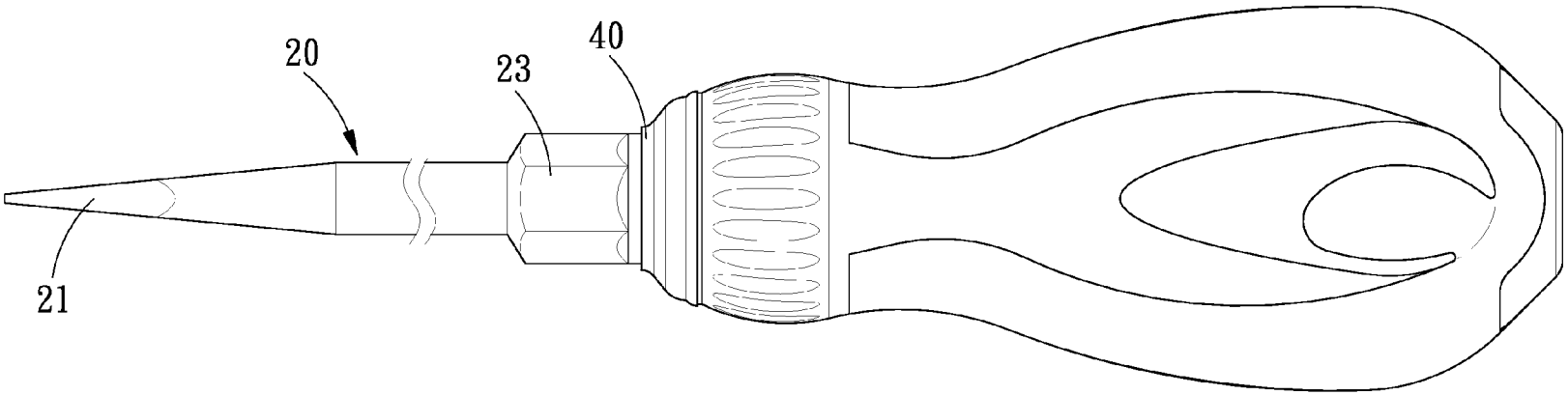
FIG. 8 is a side view of the screwdriver in accordance with the present invention, showing that a stop portion is formed on the shaft of the screwdriver.

Referring to FIG. 8, a stop portion 23 is formed between the engaging portion 22 and the driving head 21 of the shaft 20 and stopped against the end surface of the handle body 40, so as to prevent the displacement of the handle body 40 during impacting operation.

While we have shown and described various embodiments in accordance with the present invention, it is clear to those skilled in the art that further embodiments may be made without departing from the scope of the present invention.

What is claimed is:

1. A screwdriver comprising:

a shaft with a driving head and an engaging portion at opposing ends thereof, and the engaging portion including a first section and a second section;

a handle core including a fixing portion fixed at the first section of the shaft, an impact portion and a plurality of protrusions annularly located on an outer surface of the handle core, each two neighboring protrusions defining a recess therebetween;

a handle body covering the second section of the shaft and the handle core and including an open end for exposing the impact portion of the handle core, a groove defined in an outer surface of the handle body, and a plurality of engaging recesses and engaging protrusions formed in an inner surface of the handle body for engaging with the protrusions and recesses of the handle core; and an outer layer disposed in the groove of the handle body.

2. The screwdriver as claimed in claim 1, wherein the handle core is made by injection molding nylon.

3. The screwdriver as claimed in claim 1, wherein the protrusions and recesses of the handle core are located between the fixing portion and the impact portion.

4. The screwdriver as claimed in claim 1, wherein the handle body is made by injection molding acrylonitrile-butadene-styrene compound.

5. The screwdriver as claimed in claim 1, wherein the handle body is made of a compound consisting of Polypropylene, fiber and thermo plastic rubber.

6. The screwdriver as claimed in claim 1, wherein the outer layer is made of injection molding of thermo plastic rubber.

7. The screwdriver as claimed in claim 1, wherein the outer layer is made of injection molding of oil resistant thermo plastic rubber.

8. The screwdriver as claimed in claim 1, wherein a stop portion is formed between the engaging portion and the driving head of the shaft and stopped against an end surface of the handle body.

9. The screwdriver as claimed in claim 1, wherein the first section of the shaft is provided with a first wing portion which is symmetrically located on an outer periphery of the first section, and the second section of the shaft is also provided with a second wing portion symmetrically located on an outer periphery of the second section, the fixing portion of the handle core is provide with a first covering portion for covering the first wing portion, and the handle body is provided with a second covering portion for covering the second wing portion.

* * * * *